United States Patent [19]

Tuitt

[11] 4,427,125

[45] Jan. 24, 1984

[54] FOOD DEPRESSOR TYPE LID

[75] Inventor: Milton J. Tuitt, Sunnyvale, Calif.

[73] Assignee: Container Corporation of America, Chicago, Ill.

[21] Appl. No.: 389,574

[22] Filed: Jun. 18, 1982

[51] Int. Cl.[3] ..... B65D 51/26

[52] U.S. Cl. ..... 215/231

[58] Field of Search ..... 215/231; 426/124; 220/93; 229/5.5, 43

[56] References Cited

U.S. PATENT DOCUMENTS 3,037,653 6/1962 Morisette ..... 215/231

3,771,713 11/1973 Davidson ..... 426/119 X

*Primary Examiner*—Donald F. Norton

*Attorney, Agent, or Firm*—Richard W. Carpenter; Davis Chin

[57] ABSTRACT

A food depressor type lid for a container comprising a central panel having a plurality of integral, transversely extending, reinforcing ribs projecting upwardly therefrom.

6 Claims, 7 Drawing Figures

FOOD DEPRESSOR TYPE LID

BACKGROUND OF THE INVENTION

1. Field of the Invention

This invention relates to packages for containing fruits, vegetables, and other types of food which are packed in a liquid medium.

The invention is particularly concerned with a food depressor type lid which can be used, not only to close the upper end of the container, but also to depress or force the food toward the bottom of the container, so that it remains covered by the liquid medium. This is necessary in certain steps of preparation of the food, because if certain food products extend above the liquid medium they tend to deteriorate.

This package represents an improvement over the type of food depressor type lid which is disclosed in prior U.S. Pat. No. 3,037,653.

2. Description of the Prior Art

A prior search directed to the subject matter of this application in the United States Patent and Trademark Office disclosed the following U.S. Pat. Nos. 666,159; 1,345,711; 1,608,422; 1,782,915; 1,860,567; 1,88,495; 2,857,068; 3,037,653; 4,192,443.

None of the prior art patents uncovered in the search disclosed a food depressor type lid having a main panel comprising a plurality of pie-shaped panel sections interconnected by reinforcing ribs having interlocking engagement with each other in the center of the panel, which serve to reinforce and strengthen the lid, so it can be used to effectively depress food within a tubular container to maintain it in a liquid.

SUMMARY OF THE INVENTION

It is a object of the invention to provide, in a food-type depressor lid of the type described, a horizontal panel having a plurality of transversely extending reinforcing ribs which project upwardly from the main panel to reinforce the lid.

A more specific object of the invention is the provision of a lid of the type described which includes a main panel having a plurality of pie-shaped panel sections joined to each other by reinforcing rib members which, in turn, are connected to each other at the center of the structure to provide a reinforced lid arrangement.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
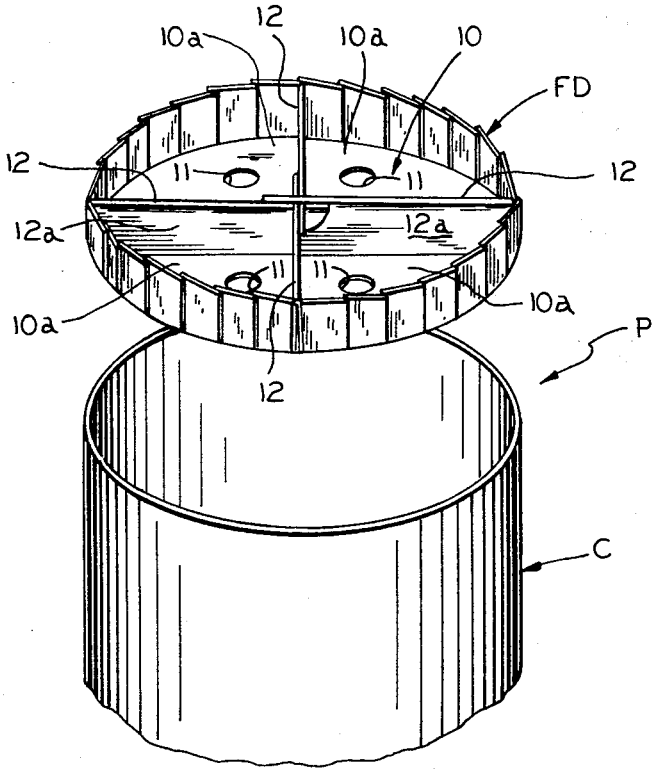
FIG. 1 is a fragmentary exploded, perspective view of a container and lid embodying features of the invention, with the lid shown in the erected or assembled condition.

Referring now to the drawings for a better understanding of the invention, and particularly to FIG. 1, it will be seen that the novel package indicated generally at P includes a food depressor type lid FD adapted to be received within a tubular container indicated generally at C.

Figure 2:
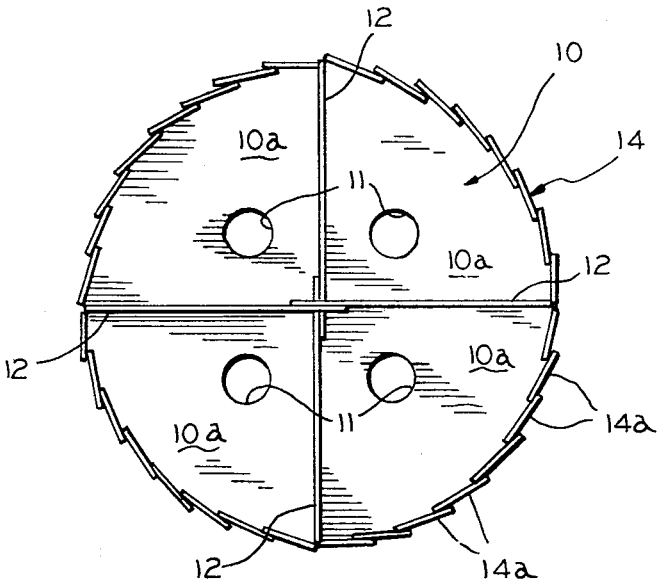
FIG. 2 is a top plan view of the lid structure illustrated in FIG. 1.
Figure 3:
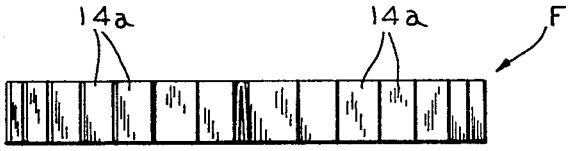
FIG. 3 is a side elevational view of the structure illustrated in FIG. 2.
Figure 4:
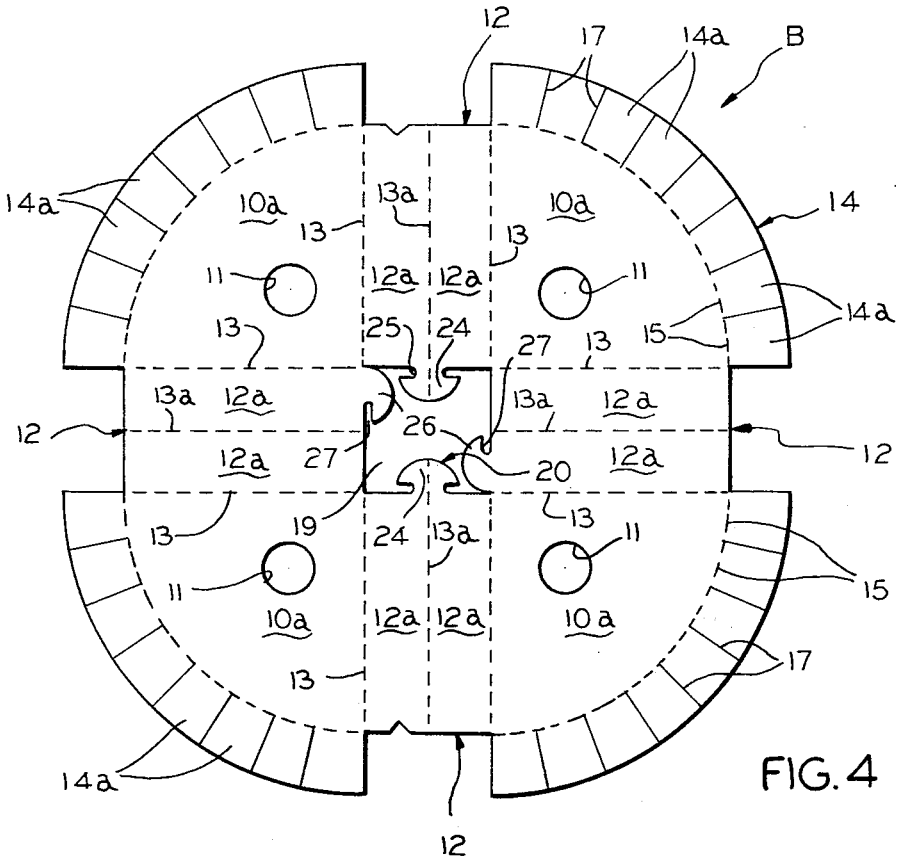
FIG. 4 is a plan view of a blank of foldable sheet material from which the lid illustrated in the other views may be formed.

Lid FD may be formed from a flat unitary blank B of foldable sheet material, such as paperboard, illustrated in FIG. 4. As best seen in FIGS. 2, 3 and 4, lid FD includes a preferably round main or center panel 10 which made up a plurality of generally pie-shaped sections 10*a* each of which is provided with an opening 11 extending therethrough.

As best seen in FIG. 4, in the blank B, panel sections 10*a* have their side edges spaced from each other with radial center lines of the sections intersecting at the center of the blank.

Each pair of adjacent panel sections 10*a* are connected to each other by a reinforcing rib 12 member having a pair of relatively narrow elongated elements 12*a* which are foldably joined along their outer edges on fold lines 13 to adjacent side edges of related panel sections 10*a* and which are foldably joined at their inner edges to each other on fold lines 13*a*.

Lid FD includes an outer peripheral rim portion 14 which is comprised of a plurality of outer or friction flanges 14*a* foldably joined on fold lines 15 to the outer edges of the panel sections 10*a*. Flanges 14*a* are separated from each other by a plurality of radially extending cut lines 17.

As best seen in FIG. 4, there is an opening 19 at the center of the blank B between the inner ends of the rib members 12.

Still referring to FIG. 4 it will be seen that formed integrally with and projecting into opening 19, in the blank, from the rib members 14 are opposed pairs of male and female lock tabs 20 and 26, respectively.

Each of the male lock tabs 20 include a pair of lock sections 24 which are foldably joined to each other by related fold line 13*a*. Male lock tabs 20 include an enlarged head portion 24 and a reduced neck portion 25.

Female lock tabs 26 include a throat or slot 27 located adjacent the rib member to which the female lock tab 26 is connected.

Figure 5:
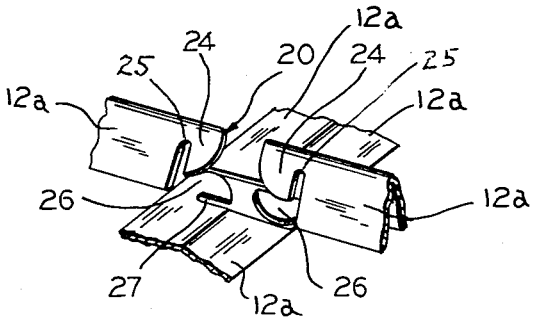
FIGS. 5, 6 and 7 are fragmentary perspective views of portions of the structure illustrated in FIG. 1 showing the manner in which the reinforcing rib members are secured to each other in interlocking relationship.
Figure 6:
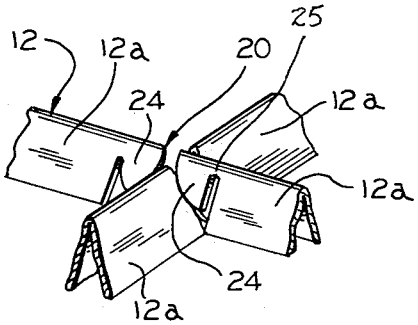
Figure 7:
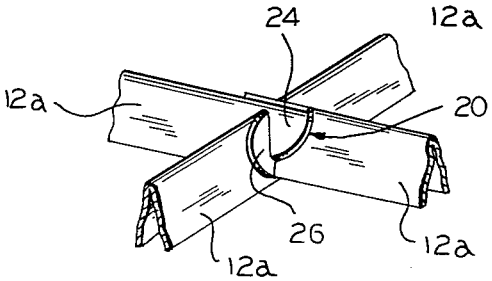

In assembling the structure, the rib sections 12*a* of each of the rib members are folded together in face-to-face relation, which in turn brings adjacent edges of the related panel sections 10*a* of main panel 10 together to form a generally round complete panel, with the rib members 12 projecting upwardly therefrom to reinforce the panel. As the rib sections are folded together and the inner ends of the rib members are brought together the male lock tabs 20 are moved into interlocking relation with the female lock tabs 26, as best seen in FIGS. 5, 6 and 7, so that the male lock tabs 20 are received within the throats 27 of the female lock tabs to provide a tight interlocking engagement between the rib members which serves to maintain the rib members in an erected condition and projecting upwardly from the main panel to reinforce and strengthen the lid.

The outer flanges 14*a* are folded at right angles to their respective panel sections, as shown in FIGS. 1 and 3, so that when the lid is placed within a container the flanges form a friction fit to maintain the lid snugly within the container.

What is claimed is:

1. A food depressor type lid for a tubular container, said lid being formed of a unitary blank of foldable paperboard and comprising:

(a) a horizontally disposed central panel having at least one opening extending therethrough;

(b) an outer rim section including a plurality of integral flanges foldably joined to the outer edge of said central panel and extending generally normal thereto for frictional engagement with an inner surface of a tubular container;

(c) a plurality of pairs of radially aligned, vertically disposed, transversely extending, reinforcing rib members projecting upwardly from the upper side of said central panel;

(d) a first pair of said rib members having opposed male lock tabs disposed at its radially inner ends;

(e) a second pair of said rib members having opposed female lock tabs disposed at its radially inner ends; and (f) each of said opposed male lock tabs having an enlarged head portion and a reduced neck portion, each of said opposed female lock tabs having a slot located adjacent its respective rib member, said male lock tabs being received within said slots of said female lock tabs for interlocking engagement.

2. A lid according to claim 1, wherein said central panel includes a plurality of generally pie-shaped sections, with each pair of adjacent sections being joined to each other by one of said rib members which is interposed therebetween.

3. A lid according to claim 2, wherein each of said rib members includes a pair of rib elements which are:

(a) foldably joined at their lower edges to adjacent edges of related central panel sections;

(b) foldably joined at their upper edges to each other;

(c) disposed in face-to-face relationship with each other.

4. A unitary blank of foldable sheet material, such as paperboard, which is cut and scored for use in forming a food depressor type lid for a tubular container, said blank comprising:

(a) a plurality of generally pie-shaped panel sections spaced from each other but having radial center lines intersecting at a common point;

(b) each of said sections being connected to an adjacent section by a reinforcing rib member which includes a pair of rib elements having outer edges foldably joined to adjacent side edges of related panel sections and having inner edges foldably joined to each other;

(c) a first pair of said rib members having opposed male lock tabs disposed at its radially inner ends;

(d) a second pair of said rib members having opposed female lock tabs disposed at its radially inner ends; and (e) each of said opposed male lock tabs having an enlarged head portion and a reduced neck portion, each of said opposed female lock tabs having a slot located adjacent its respective rib member, said male lock tabs being received within said slots of said female lock tabs for interlocking engagement when said blank is erected to the assembled condition.

5. A blank according to claim 4, wherein said panel sections each have a plurality of outer friction flanges foldably joined to the outer edges thereof.

6. A blank according to claim 4, wherein said panel sections have openings extending therethrough.

* * * * *